US006750193B1

(12) United States Patent
Holderbaum et al.

(10) Patent No.: US 6,750,193 B1
(45) Date of Patent: Jun. 15, 2004

(54) METHOD FOR PRODUCING MULTI-PHASE CLEANING AND WASHING AGENT SHAPED BODIES

(75) Inventors: Thomas Holderbaum, Monheim (DE); Hans-Josef Beaujean, Dormagen (DE); Juergen Haerer, Duesseldorf (DE); Christian Nitsch, Duesseldorf (DE); Bernd Richter, Leichlingen (DE); Markus Semrau, Timmaspe (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/743,466

(22) PCT Filed: Jul. 6, 1999

(86) PCT No.: PCT/EP99/04675

§ 371 (c)(1),
(2), (4) Date: Jun. 12, 2001

(87) PCT Pub. No.: WO00/04122

PCT Pub. Date: Jan. 27, 2000

(30) Foreign Application Priority Data

Jul. 15, 1998 (DE) ..... 198 31 704
Nov. 9, 1998 (DE) ..... 198 51 426

(51) Int. Cl.[7] ..... C11D 11/00

(52) U.S. Cl. ..... 510/446; 510/224; 510/294; 510/298

(58) Field of Search ..... 510/446, 224, 510/294, 298

(56) References Cited

U.S. PATENT DOCUMENTS

| | | | | |
|---|---|---|---|---|
| 3,234,258 A | | 2/1966 | Morris | 260/460 |
| 4,664,839 A | | 5/1987 | Rieck | 252/175 |
| 4,820,439 A | | 4/1989 | Rieck | 252/135 |
| 5,075,041 A | | 12/1991 | Lutz | 252/548 |
| 5,417,951 A | | 5/1995 | Just | 423/334 |
| 5,516,448 A | * | 5/1996 | Capeci et al. | 510/441 |
| 5,780,420 A | | 7/1998 | Breuer et al. | 510/466 |
| 6,075,001 A | | 6/2000 | Wilde | 510/376 |
| 6,211,129 B1 | * | 4/2001 | Gladfelter et al. | 510/294 |
| 6,274,538 B1 | * | 8/2001 | Addison | 510/224 |
| 6,303,561 B1 | * | 10/2001 | Painter | 510/446 |
| 6,358,911 B1 | * | 3/2002 | Metzger-Groom | 510/446 |
| 6,399,564 B1 | * | 6/2002 | Speed et al. | 510/446 |

FOREIGN PATENT DOCUMENTS

| | | | |
|---|---|---|---|
| CA | 2 298 105 | | 5/2000 |
| CA | 2 298283 | | 5/2000 |
| CA | 2 298 847 | | 5/2000 |
| DE | 44 00 024 | | 7/1995 |
| DE | 196 16 693 | | 11/1997 |
| DE | 196 16 767 | | 11/1997 |
| DE | 197 09 991 | | 9/1998 |
| DE | 197 10 254 | | 9/1998 |
| DE | 197 58 178 | | 7/1999 |
| DE | 197 58 180 | | 7/1999 |
| DE | 197 58 181 | | 7/1999 |
| DE | 198 22 973 | | 12/1999 |
| EP | 0 055 100 | | 6/1982 |
| EP | 0 164 514 | | 4/1985 |
| EP | 0 481 547 | | 4/1992 |
| JP | 58/217598 | | 12/1983 |
| JP | 09715992 | A2 * | 7/1997 |
| WO | WO90/13533 | | 11/1990 |
| WO | WO91/08171 | | 6/1991 |
| WO | WO95/07331 | | 3/1995 |
| WO | WO98/11187 | | 3/1998 |
| WO | WO98/40463 | | 9/1998 |
| WO | WO 99/24547 | * | 5/1999 |
| WO | WO99/24550 | | 5/1999 |

OTHER PUBLICATIONS

Rompp, 9, Auflage, Band 6, p. 4440, 1992.
Voigt, Lehrbuch der pharmazeutischen Technologie, 6, Auflage, 1987, pp. 182–184.

* cited by examiner

*Primary Examiner*—Lorna M. Douyon
(74) *Attorney, Agent, or Firm*—Stephen D. Harper; Glenn E. J. Murphy

(57) ABSTRACT

A method for providing multi-phase cleaning and washing agent shaped bodies is provided. A particulate premix ix compressed to form a shaped body containing a cavity and the cavity is filled with a molten suspension or emulsion of a matrix material with a melting point above 30% and at least one active material dispersed or suspended in the matrix material.

32 Claims, No Drawings

METHOD FOR PRODUCING MULTI-PHASE CLEANING AND WASHING AGENT SHAPED BODIES

CROSS-REFERENCE TO RELATED APPLICATIONS

This application is a U.S. National Stage application filed under 35 U.S.C. § 371, claiming priority under 35 U.S.C. §§ 119 and 365 of International Application No. PCT/EP99/04675, filed Jul. 6, 1999, in the European Patent Office, and DE 198 31 704.2, filed Jul. 15, 1998, and DE 198 51 426.3, filed Nov. 9, 1998, in the German Patent Office.

FIELD OF THE INVENTION

This invention relates generally to the production of cleaning tablets and, more particularly, to process for the production of multiphase cleaning tablets where advantages in terms of cleaning performance are achieved through the division into several phases. Corresponding cleaning tablets include, for example, laundry detergent tablets, tablets for machine dishwashing or for cleaning hard surfaces, bleach tablets for use in washing and dishwashing machines, water softening tablets and stain removing tablets.

BACKGROUND OF THE INVENTION

Cleaning tablets belonging to the product classes mentioned are widely described in the prior art literature and, being easy to dose, are enjoying increasing popularity among consumers. Tabletted detergents have a number of advantages over powder-form or liquid products. They are easier to dose and handle and, by virtue of their compact structure, have advantages in regard to storage and transportation. Accordingly, there is an extremely broad prior art on cleaning tablets which is also reflected in extensive patent literature. At a very early stage, developers of tablet-form products came up with the idea of releasing certain ingredients into the wash cycle under defined conditions through differently composed parts or regions of the tablets in order in this way to improve the outcome of the cleaning process. Besides the core/jacket tablets and ring/core tablets known for some time in the pharmaceutical industry, multilayer tablets in particular have been successfully used and are now available for many aspects of washing and cleaning or hygiene.

Multiphase lavatory cleaning tablets are described, for example, in European patent application EP 0 055 100 (Jeyes Group). This document discloses toilet cleaning blocks which comprise a tablet of a slowly dissolving cleaning composition in which a bleaching tablet is embedded. The document in question also discloses various embodiments of multiphase tablets. According to the teaching of EP 0 055 100, the tablets are produced either by introducing a bleaching tablet into a mold and coating the tablet with the cleaning composition or by casting part of the cleaning composition into the mold, introducing the bleaching tablet and, optionally, overcoating with more cleaning composition. The filling of preformed cavities is neither described nor suggested in this document.

EP 481 547 (Unilever) describes multiphase cleaning tablets which are intended for use in dishwashing machines. These tablets are core/jacket tablets and are produced by compressing the ingredients in stages. First, a bleaching composition is compressed to a form a tablet which is introduced into a die half-filled with a polymer composition which is then filled with more polymer composition and compressed to form a bleaching tablet with a polymer jacket. The procedure is then repeated with an alkaline detergent composition so that a three-phase tablet is obtained. The document in question does not mention the possibility of introducing substances into tablets in the form of a melt.

The controlled release aspect of ingredients has been, and is still being, intensively investigated inter alia in the field of detergents, so that several publications are also available on the subject. So far as cleaning tablets are concerned, most publications suggest the accelerated release of certain regions of the tablet by disintegration aids or effervescent systems whereas the slower release of individual ingredients, for example by coating or by the selective delay of dissolution, tends to assume a lesser role.

The problem addressed by the present invention was to provide a process for producing multiphase cleaning tablets by which it would be possible to produce tablets that would enable certain ingredients to be released under control at predetermined times in the wash cycle. In particular, it would be possible by the process according to the invention to produce cleaning tablets which would be distinguished by excellent storage and transport stability and which would be superior to conventional tablets in their performance in various fields of application. Accordingly, the process to be provided by the invention would also be expected to allow the cleaning tablets to be produced with maximum freedom of formulation for these various applications.

BRIEF DESCRIPTION OF THE INVENTION

It has now been found that cleaning tablets with the requisite properties can be made in a simple and flexible manner by producing tablets comprising a cavity which is subsequently filled with a melt dispersion or emulsion of certain active substances.

Accordingly, the present invention relates to a process for the production of multiphase cleaning tablets comprising the steps of a) tabletting a particulate premix to form tablets comprising a cavity,
b) preparing a melt suspension or emulsion from a coating material with a melting point above 30° C. and one or more active substance(s) dispersed or suspended therein,
c) filling the cavity tablets with the melt suspension or emulsion at temperatures above the melting point of the coating material and
d) cooling and optionally aftertreating the filled cleaning tablets.

DETAILED DESCRIPTION OF THE INVENTION

Process Step a)

The particulate premix to be tabletted may contain the ingredients typically present in detergents in varying quantities according to the application envisaged for the cleaning tablets produced by the process according to the invention. More particularly, the premix may contain substances from the group of surfactants, builders and complexing agents, bleaching agents, bleach activators, enzymes, polymers and dyes and perfumes. However, certain substances from the groups mentioned may be intentionally omitted from the premix and incorporated as active substance in the melt suspension or emulsion of process step b). Depending on the coating material and active substance selected, it is thus possible to produce tablets which release certain active substances from the tablet either early in the wash cycle or with delay.

Preferred ingredients of the particulate premix are substances from the group of builders. Besides the detersive substances, builders are the most important ingredients of detergents. The cleaning tablets produced in accordance with the invention may contain any of the builders typically used in detergents, i.e. zeolites, silicates, carbonates, organic cobuilders and—providing there are no ecological objections to their use—the phosphates. The builders mentioned may also be used in surfactant-free tablets so that tablets suitable for softening water can be produced in accordance with the invention.

Suitable crystalline layered sodium silicates correspond to the general formula $NaMSi_xO_{2x+1}\cdot yH_2O$, where M is sodium or hydrogen, x is a number of 1.9 to 4 and y is a number of 0 to 20, preferred values for x being 2, 3 or 4. Crystalline layered silicates such as these are described, for example, in European patent application EP-A-0 164 514. Preferred crystalline layered silicates corresponding to the above formula are those in which M is sodium and x assumes the value 2 or 3. Both β- and Δ-sodium disilicates $Na_2Si_2O_5\cdot yH_2O$ are particularly preferred, β-sodium disilicate being obtainable, for example, by the process described in International patent application WO-A-91/08171.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-44 00 024. Compacted amorphous silicates, compounded amorphous silicates and overdried X-ray-amorphous silicates are particularly preferred.

The finely crystalline, synthetic zeolite containing bound water used in accordance with the invention is preferably zeolite A and/or zeolite P. Zeolite MAP® (Crosfield) is a particularly preferred P-type zeolite. However, zeolite X and mixtures of A, X and/or P are also suitable. According to the invention, it is also preferred to use, for example, a co-crystallizate of zeolite X and zeolite A (ca. 80% by weight zeolite X) which is marketed by CONDEA Augusta S.p.A. under the name of VEGOBOND AX® and which may be described by the following formula:

$$nNa_2O\cdot(1-n)K_2O\cdot Al_2O_3\cdot(2-2.5)SiO_2\cdot(3.5-5.5)H_2O.$$

The zeolite may be used both as a builder in a granular compound and for "powdering" the entire mixture to be tabletted, both these options normally being used to incorporate the zeolite in the premix. Suitable zeolites have a mean particle size of less than 10 μm (volume distribution, as measured by the Coulter Counter Method) and contain preferably 18 to 22% by weight and more preferably 20 to 22% by weight of bound water.

The generally known phosphates may of course also be used as builders providing their use should not be avoided on ecological grounds. The sodium salts of the orthophosphates, the pyrophosphates and, in particular, the tripolyphosphates are particularly suitable.

Useful organic builders are, for example, the polycarboxylic acids usable, for example, in the form of their sodium salts, such as citric acid, adipic acid, succinic acid, glutaric acid, tartaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

Alkali sources may be present as additional constituents. Alkali sources in the context of the present invention are alkali metal hydroxides, alkali metal carbonates, alkali metal hydrogen carbonates, alkali metal sesquicarbonates, alkali metal silicates, alkali metal metasilicates and mixtures thereof, alkali metal carbonates, more particularly sodium carbonate, sodium hydrogen carbonate or sodium sesquicarbonate, being preferred for the purposes of the invention.

If dishwasher tablets are to be produced by the process according to the invention, water-soluble builders are preferred because, generally, they tend less to form insoluble residues on dishes and hard surfaces. Conventional builders which may be present in quantities of 10 to 90% by weight (based on the premix to be tabletted) in the production of dishwasher detergents in accordance with the invention are the low molecular weight polycarboxylic acids and salts thereof, the homopolymeric and copolymeric polycarboxylic acids and salts thereof, the carbonates, phosphates and silicates. Trisodium citrate and/or pentasodium tripolyphosphate and/or sodium carbonate and/or sodium bicarbonate and/or gluconates and/or silicate-based builders from the class of disilicates and/or metasilicates are preferably used for the production of dishwasher tablets. A builder system containing a mixture of tripolyphosphate and sodium carbonate is particularly preferred. A builder system containing a mixture of tripolyphosphate and sodium carbonate and sodium disilicate is also particularly preferred.

Irrespective of the application envisaged for the tablets according to the invention, the particulate premix tabletted in step a) contains builders in quantities of normally 20 to 80% by weight, preferably 25 to 75% by weight and more preferably 30 to 70% by weight, based on the premix.

In addition to the builders described above, the premix may also contain the detersive substances already mentioned which are particularly important ingredients for cleaning tablets. Depending on the tablet to be produced, different answers are possible to the questions of whether to use surfactants and, if so, which surfactants to use. Laundry detergent tablets may normally contain various surfactants from the groups of anionic, nonionic, cationic and amphoteric surfactants whereas dishwasher tablets preferably contain only low-foaming nonionic surfactants and water softening tablets or bleach tablets are free from surfactants. When it comes to incorporating the surfactants in the particular premix to be compressed, there are no limits to the freedom of formulation available to the expert.

Suitable anionic surfactants are, for example, those of the sulfonate and sulfate type. Suitable surfactants of the sulfonate type are preferably $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of α-sulfofatty acids (ester sulfonates), for example the α-sulfonated methyl esters of hydrogenated coconut oil, palm kernel oil or tallow fatty acids, are also suitable.

Other suitable anionic surfactants are sulfonated fatty acid glycerol esters. Fatty acid glycerol esters in the context of the present invention are the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid.

Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates, $C_{12-15}$ alkyl sulfates and Crass alkyl sulfates are preferred from the point of view of washing technology. Other suitable anionic surfactants are 2,3-alkyl sulfates which may be produced, for example, in accordance with U.S. Pat. No. 3,234,258 or U.S. Pat. No. 5,075,041 and which are commercially obtainable as products of the Shell Oil Company under the name of DAN®.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantities of 1 to 5% by weight, in dishwashing detergents.

Other suitable anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol residues or mixtures thereof. Particularly preferred sulfosuccinates contain a fatty alcohol residue derived from ethoxylated fatty alcohols which, considered in isolation, represent nonionic surfactants (for a description, see below). Of these sulfosuccinates, those of which the fatty alcohol residues are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

According to the invention, the production of laundry detergent tablets containing 5 to 50% by weight, preferably 7.5 to 40% by weight and more preferably 10 to 20% by weight of anionic surfactant(s), based on the weight of the tablets, is preferred.

So far as the choice of the anionic surfactants used in the cleaning tablets according to the invention is concerned, there are no basic requirements to restrict freedom of formulation. However, preferred laundry detergent tablets do have a soap content of more than 0.2% by weight, based on the total weight of the tablet. Preferred anionic surfactants are the alkyl benzenesulfonates and fatty alcohol sulfates, preferred cleaning tablets containing 2 to 20% by weight, preferably 2.5 to 15% by weight and more preferably 5 to 10% by weight of fatty alcohol sulfate(s), based on the weight of the tablet.

Preferred nonionic surfactants are alkoxylated, advantageously ethoxylated, more especially primary alcohols preferably containing 8 to 18 carbon atoms and, on average, 1 to 12 moles of ethylene oxide (EO) per mole of alcohol, in which the alcohol radical may be linear or, preferably, methyl-branched in the 2-position or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil, palm oil, tallow fatty or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more especially the fatty acid methyl esters which are described, for example, in Japanese patent application JP 58/217598 or which are preferably produced by the process described in International patent application WO-A-90/13533.

Another class of nonionic surfactants which may advantageously be used are the alkyl polyglycosides (APGs). Suitable alkyl polyglycosides correspond to the general formula $RO(G)_z$ where R is a linear or branched, more particularly 2-methyl-branched, saturated or unsaturated aliphatic radical containing 8 to 22 and preferably 12 to 18 carbon atoms and G stands for a glycose unit containing 5 or 6 carbon atoms, preferably glucose. The degree of glycosidation z is between 1.0 and 4.0, preferably between 1.0 and 2.0 and more preferably between 1.1 and 1.4.

Linear alkyl polyglucosides, i.e. alkyl polyglycosides in which the polyglycosyl moiety is a glucose unit and the alkyl moiety is an n-alkyl group, are preferably used.

The cleaning tablets according to the invention may advantageously contain alkyl polyglycosides, APG contents in the tablets of more than 0.2% by weight, based on the tablet as a whole, being preferred. Particularly preferred cleaning tablets contain APGs in quantities of 0.2 to 10% by weight, preferably in quantities of 0.2 to 5% by weight and more preferably in quantities of 0.5 to 3% by weight.

Nonionic surfactants of the amine oxide type, for example N-cocoalkyl-N,N-dimethylamine oxide and N-tallowalkyl-N,N-dihydroxyethylamine oxide, and the fatty acid alkanolamide type are also suitable. The quantity in which these nonionic surfactants are used is preferably no more than the quantity in which the ethoxylated fatty alcohols are used and, more preferably, no more than half that quantity.

Other suitable surfactants are polyhydroxyfatty acid amides corresponding to formula (I):

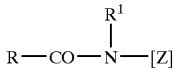

(I)

in which RCO is an aliphatic acyl group containing 6 to 22 carbon atoms, $R^1$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (II):

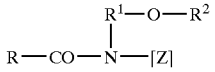

(II)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and m is a linear polyhydroxyalkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331.

In the production of dishwasher tablets, the surfactants used may again be selected in principle from any surfactants. However, the nonionic surfactants described above are preferably used for this particular application, low-foaming nonionic surfactants being particularly suitable. Alkoxylated alcohols, above all ethoxylated and/or propoxylated alcohols, are particularly preferred. The expert generally understands alkoxylated alcohols to be the reaction products of alkylene oxide, preferably ethylene oxide, with alcohols, preferably—for the purposes of the present invention—relatively long-chain alcohols ($C_{10}$ to $C_{18}$, preferably $C_{12}$ to $C_{16}$, such as for example $C_{11}$, $C_{12}$, $C_{13}$, $C_{14}$, $C_{15}$, $C_{16}$, $C_{17}$ and $C_{18}$ alcohols). In general, a complex mixture of addition products with different degrees of ethoxylation is formed from n moles of ethylene oxide and 1 mole of alcohol, depending on the reaction conditions. Another embodiment consists in the use of mixtures of alkylene oxide, preferably a mixture of ethylene oxide and propylene oxide. If desired, "end-capped" alcohol ethoxylates, which may also be used in accordance with the invention, may also be obtained by etherificaton with short-chain alkyl groups, such as preferably the butyl group, in a concluding step. Highly ethoxylated fatty alcohols or mixtures thereof with end-capped fatty alcohol ethoxylates are most particularly preferred for the purposes of the invention.

In the production of dishwasher tablets by the process according to the invention, preferred process variants are characterized in that the particulate premix tabletted in step a) contains surfactant(s), preferably nonionic surfactant(s), in quantities of 0.5 to 10% by weight, preferably in quantities of 0.75 to 7.5% by weight and more preferably in quantities of 1.0 to 5% by weight, based on the premix.

In addition to the above-described ingredients from the groups of builders and surfactants, the premix to be tabletted may contain other typical ingredients of detergents, more particularly from the groups of disintegrating agents, bleaching agents, bleach activators, enzymes, perfumes, perfume carriers, fluorescers, dyes, foam inhibitors, silicone oils, redeposition inhibitors, optical brighteners, discoloration inhibitors, dye transfer inhibitors, corrosion inhibitors, etc. These substances, which may also be processed in step b) in the same way as the builders and surfactants mentioned above, are described in the following.

In order to facilitate the disintegration of heavily compressed tablets, disintegration aids known as tablet disintegrators may be incorporated to shorten the disintegration times. According to Römpp (9th Edition, Vol. 6, page 4440) and Volgt "*Lehrbuch der pharmazeutischen Technologie*" (6th Edition, 1987, pages 182–184), tablet disintegrators or disintegration accelerators are auxiliaries which provide for the rapid disintegration of tablets in water or gastric juices and for the release of the pharmaceuticals in absorbable form.

These substances undergo an increase in volume on contact with water. On the one hand, they undergo an increase in their own volume (swelling), on the other hand a pressure can be built up through the release of gases which causes the tablet to break up into relatively small particles. Well-known disintegration aids are, for example, carbonate/citric acid systems, although other organic acids may also be used. Swelling disintegrators are, for example, synthetic polymers, such as polyvinyl pyrrolidone (PVP), or natural polymers or modified natural substances, such as cellulose and starch/starch derivatives, alginates or casein derivatives.

Preferred cleaning tablets contain 0.5 to 10% by weight, preferably 3 to 7% by weight and more preferably 4 to 6% by weight of one or more disintegrators, based on the weight of the tablet.

According to the present invention, preferred disintegrators are cellulose-based disintegrators, so that preferred cleaning tablets contain a cellulose-based disintegrator in quantities of 0.5 to 10% by weight, preferably in quantities of 3 to 7% by weight and more preferably in quantities of 4 to 6% by weight. Pure cellulose has the formal empirical composition $(C_6H_{10}O_5)_n$ and, formally, is a β-1,4-polyacetal of cellobiose which, in turn, is made up of two molecules of glucose. Suitable celluloses consist of ca. 500 to 5000 glucose units and, accordingly, have average molecular weights of 50,000 to 500,000. Cellulose derivatives obtainable from cellulose by polymer-analog reactions may also be used as cellulose-based disintegrators in accordance with the present invention. These chemically modified celluloses comprise, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and amino celluloses. The cellulose derivatives mentioned are preferably not used on their own as cellulose-based disintegrators, but in the form of a mixture with cellulose. The content of cellulose derivatives in these mixtures is preferably below 50% by weight and more preferably below 20% by weight, based on the cellulose-based disintegrator. In one particularly preferred embodiment, pure cellulose free from cellulose derivatives is used as the cellulose-based disintegrator.

The cellulose used as disintegrator is preferably not used in fine-particle form, but instead is converted into a coarser form, for example by granulation or compacting, before incorporation in the premixes to be compressed. Cleaning tablets containing granular or optionally co-granulated disintegrators are described in German patent application DE 197 09 991 (Stefan Herzog) and DE 197 10 254 (Henkel) and in International patent application WO098/40463 (Henkel). These documents also contain details of the production of granulated, compacted or co-granulated cellulose disintegrators. The particle sizes of such disintegrators is generally above 200 μm, at least 90% by weight of the disintegrators preferably being between 300 and 1600 μm in size and, more preferably, between 400 and 1200 μm in size. The relatively coarse cellulose-based disintegrators mentioned above and described in detail in the cited documents are preferably used as disintegrators in accordance with the present invention and are commercially available, for example, under the name of Arbocel® TF-30-HG from Rettenmaier.

Microcrystalline cellulose may be used as another cellulose-based disintegrator or as part of such a component. This microcrystalline cellulose is obtained by partial hydrolysis of celluloses under conditions which only attack and completely dissolve the amorphous regions (ca. 30% of the total cellulose weight) of the celluloses, but leave the crystalline regions (ca. 70%) undamaged. Subsequent deaggregation of the microfine celluloses formed by the hydrolysis gives the microcrystalline celluloses which have particle sizes of around 5 μm and which may be compacted, for example, to granules with a mean particle size of 200 μm.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecane dioic acid. Where bleaching agents are used, it is again possible to leave out surfactants and/or builders so that pure bleach tablets can be produced. If such bleach tablets are to be added to the laundry, sodium carbonate is preferably used irrespective of what other ingredients the tablets contain. If detergent or bleach tablets for dishwashing machines are being produced, bleaching agents from the group of organic bleaches may also be used. Typical organic bleaching agents are diacyl peroxides, such as dibenzoyl peroxide for example. Other typical organic bleaching agents are the peroxy acids, of which alkyl peroxy acids and aryl peroxy acids are particularly mentioned as examples. Preferred representatives are (a) peroxybenzoic acid and ring-substituted derivatives thereof, such as alkyl peroxybenzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di(6-aminopercaproic acid).

Other suitable bleaching agents in dishwasher tablets are chlorine- and bromine-releasing substances. Suitable chlorine- or bromine-releasing materials are, for example, heterocyclic N-bromamides and N-chloramides, for example trichloroisocyanuric acid, tribromoisocyanuric acid, dibromoisocyanuric acid and/or dichloroisocyanuric acid (DICA) and/or salts thereof with cations, such as potassium and sodium. Hydantoin compounds, such as 1,3-dichloro-5,5-dimethyl hydantoin, are also suitable.

In order to obtain an improved bleaching effect where washing is carried out at temperatures of 60° C. or lower, bleach activators may be incorporated in the premix to be compressed. The bleach activators may be compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate and 2,5-diacetoxy-2,5-dihydrofuran.

In addition to or instead of the conventional bleach activators mentioned above, so-called bleach catalysts may also be incorporated in the tablets. Bleach catalysts are bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

Suitable enzymes are those from the class of proteases, lipases, amylases, cellulases or mixtures thereof. Enzymes obtained from bacterial strains or fungi, such as *Bacillus subtilis, Bacillus licheniformis* and *Streptomyces griseus*, are particularly suitable. Proteases of the subtilisin type are preferred, proteases obtained from *Bacillus lentus* being particularly preferred. Enzyme mixtures, for example of protease and amylase or protease and lipase or protease and cellulase or of cellulase and lipase or of protease, amylase and lipase or of protease, lipase and cellulase, but especially cellulase-containing mixtures, are of particular interest. Peroxidases or oxidases have also proved to be suitable in some cases. The enzymes may be adsorbed to supports and/or encapsulated in membrane materials substances to protect them against premature decomposition. The percentage content of the enzymes, enzyme mixtures or enzyme granules in the tablets according to the invention may be, for example, from about 0.1 to 5% by weight and is preferably from 0.1 to about 2% by weight.

In addition, the premix to be tabletted—for the production of laundry detergent tablets—may also contain components with a positive effect on the removability of oil and fats from textiles by washing (so-called soil repellents). This effect becomes particularly dear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

If laundry detergent tablets are to be produced, the premix to be tabletted may contain derivatives of diaminostilbenedisulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used.

Dyes and fragrances may be added to the premix in the process according to the invention to improve the aesthetic impression created by the products and to provide the consumer not only with the required washing performance but also with a visually and sensorially "typical and unmistakable" product. Suitable perfume oils or fragrances include individual fragrance compounds, for example synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various perfumes which together produce an attractive perfume note are preferably used. Perfume oils such as these may also contain natural perfume mixtures obtainable from vegetable sources, for example pine, citrus, jasmine, patchouli, rose or ylang-ylang oil. Also suitable are clary oil, camomile oil, nettle oil, melissa oil, mint oil, cinnamon leaf oil, lime blossom oil, juniper berry oil, vetiver oil, olibanum oil, galbanum oil and labdanum oil and orange blossom oil, neroli oil, orange peel oil and sandalwood oil.

The perfumes may be directly incorporated in the premix, although it an also be of advantage to apply them to supports which strengthen the adherence of the perfume to the washing and which provide the textiles with a long-lasting fragrance through a slower release of the perfume. Suitable support materials are, for example, cyclodextrins, the cyclodextrin/perfume complexes optionally being coated with other auxiliaries.

In order to improve the aesthetic impression of the tablets produced in accordance with the invention, the premix (or parts thereof) may be colored with suitable dyes. Preferred dyes, which are not difficult for the expert to choose, have high stability in storage, are not affected by the other ingredients of the detergents or by light and do not have any pronounced substantivity for textile fibers so as not to color them.

If dishwasher tablets are to be produced, the premix to be compressed may contain corrosion inhibitors to protect the tableware or the machine itself, silver protectors being particularly important for dishwashing machines. Known corrosion inhibitors may be used. Above all, silver protectors selected from the group of triazoles, benzotriazoles, bisbenzotriazoles, aminotriazoles, alkylaminotriazoles and the transition metal salts or complexes may generally be used. Benzotriazole and/or alkylaminotriazole is/are particularly preferred. In addition, dishwashing formulations often contain corrosion inhibitors containing active chlorine which are capable of distinctly reducing the corrosion of silver surfaces. Chlorine-free dishwashing detergents contain in particular oxygen and nitrogen-containing organic redox-active compounds, such as dihydric and trihydric phenols, for example hydroquinone, pyrocatechol, hydroxyhydroquinone, gallic acid, phloroglucinol, pyrogallol and derivatives of these compounds. Salt-like and complex-like inorganic compounds, such as salts of the metals Mn, Ti, Zr, Hf, V, Co and Ce are also frequently used. Of these, the transition metal salts selected from the group of manganese and/or cobalt salts and/or complexes are preferred, cobalt(ammine) complexes, cobalt(acetate) complexes, cobalt(carbonyl) complexes, chlorides of cobalt or manganese and manganese sulfate being particularly preferred. Zinc compounds may also be used to prevent the corrosion of tableware.

The premix may be made up of various substances as described in the foregoing. Irrespective of the composition of the premixes to be tabletted in step a), physical parameters of the premixes may be selected so that advantageous tablet properties are obtained.

Thus, in preferred variants of the process according to the invention, the particulate premixes tabletted in step a) have bulk densities above 600 g/l, preferably above 700 g/l and more preferably above 800 g/l.

The particle size of the premixes to be tabletted may also be adjusted to obtain favorable tablet properties. In preferred processes, the particulate premix tabletted in step a) has a particle size distribution where less than 10% by weight, preferably less than 7.5% by weight and more preferably less than 5% by weight of the particles are larger than 1600 μm or smaller than 200 μm in size. Narrower particle size distributions are even more preferred. Particularly advantageous variants of the process are characterized in that the particulate premix tabletted in step a) has a particle size distribution where more than 30% by weight, preferably more than 40% by weight and more preferably more than 50% by weight of the particles have a particle size of 600 to 1000 μm.

Step a) of the process according to the invention is not confined to compressing just one particulate premix to form a cavity tablet. Instead, process step a) may also be augmented to the extent that multilayer tablets are produced in known manner by preparing two or more premixes which are pressed onto one another. In this case, the first premix introduced is lightly precompressed in order to obtain a smooth upper surface running parallel to the base of the tablet and, after the second premix has been introduced, the whole is compressed to form the final tablet. In the case of tablets with three or more layers, each addition of premix is followed by further precompression before the tablet is compressed for the last time after addition of the last premix.

In view of the increasing outlay on equipment, tablets with a maximum of two layers are preferred in practice. Even in this intermediate step in the process according to the invention, advantages can be obtained from the distribution of certain ingredients between the individual layers.

For example, in preferred processes, two-layer cavity tablets are produced in step a) by compressing onto one another two different particulate premixes of which one contains one or more bleaching agents and the other contains one or more enzymes. Not only can this separation of bleaching agent and enzymes afford advantages, the separation of bleaching agents and optional bleach activators can also be of advantage so that preferred variants of the process according to the invention are characterized in that two-layer cavity tablets are produced in step a) by compressing onto one another two different particulate premixes of which one contains one or more bleaching agents and the other one or more bleach activators.

To produce the cavity tablets in step a) of the process according to the invention, the premix is compacted between two punches in a die to form a solid compactate. This process, which is referred to in short hereinafter as tabletting, comprises four phases, namely metering, compacting (elastic deformation), plastic deformation and ejection.

The premix is first introduced into the die, the filling level and hence the weight and shape of the tablet formed being determined by the position of the lower punch and the shape of the die. Uniform metering, even at high tablet throughputs, is preferably achieved by volumetric metering of the premix. As the tabletting process continues, the top punch comes into contact with the premix and continues descending towards the bottom punch. During this compaction phase, the particles of the premix are pressed closer together, the void volume in the filling between the punches continuously diminishing. The plastic deformation phase in which the particles coalesce and form the tablet begins from a certain position of the top punch (and hence from a certain pressure on the premix). Depending on the physical properties of the premix, its constituent particles are also partly crushed, the premix sintering at even higher pressures. As the tabletting rate increases, i.e. at high throughputs, the elastic deformation phase becomes increasingly shorter so that the tablets formed can have more or less large voids. In the final step of the tabletting process, the tablet is forced from the die by the bottom punch and carried away by following conveyors. At this stage, only the weight of the tablet is definitively established because the tablets can still change shape and size as a result of physical processes (re-elongation, crystallographic effects, cooling, etc.).

The tabletting process is carried out in commercially available tablet presses which, in principle, may be equipped with single or double punches. In the latter case, not only is the top punch used to build up pressure, the bottom punch also moves towards the top punch during the tabletting process while the top punch presses downwards. For small production volumes, it is preferred to use eccentric tablet presses in which the punch(es) is/are fixed to an eccentric disc which, in turn, is mounted on a shaft rotating at a certain speed. The movement of these punches is comparable with the operation of a conventional four-stroke engine. Tabletting can be carried out with a top punch and a bottom punch, although several punches can also be fixed to a single eccentric disc, in which case the number of die bores is correspondingly increased. The throughputs of eccentric presses vary according to type from a few hundred to at most 3,000 tablets per hour.

For larger throughputs, rotary tablet presses are generally used. In rotary tablet presses, a relatively large number of dies is arranged in a circle on a so-called die table. The number of dies varies—according to model—between 6 and 55, although even larger dies are commercially available. Top and bottom punches are associated with each die on the die table, the tabletting pressures again being actively built up not only by the top punch or bottom punch, but also by both punches. The die table and the punches move about a common vertical axis, the punches being brought into the filling, compaction, plastic deformation and ejection positions by means of curved guide rails. At those places where the punches have to be raised or lowered to a particularly significant extent (filling, compaction, ejection), these curved guide rails are supported by additional push-down members, pull-down rails and ejection paths. The die is filled from a rigidly arranged feed unit, the so-called filling shoe, which is connected to a storage container for the compound. The pressure applied to the premix can be individually adjusted through the tools for the top and bottom punches, pressure being built up by the rolling of the punch shank heads past adjustable pressure rollers.

To increase throughput, rotary presses can also be equipped with two filling shoes so that only half a circle has to be negotiated to produce a tablet. To produce two-layer or multiple-layer tablets, several filling shoes are arranged one behind the other without the lightly compacted first layer being ejected before further filling. Given suitable process control, shell and bull's-eye tablets—which have a structure resembling an onion skin—can also be produced in this way. In the case of bull's-eye tablets, the upper surface of the core or rather the core layers is not covered and thus remains visible. Rotary tablet presses can also be equipped with single or multiple punches so that, for example, an outer circle with 50 bores and an inner circle with 35 bores can be simultaneously used for tabletting. Modem rotary tablet presses have throughputs of more than one million tablets per hour.

Tabletting machines suitable for step a) of the process according to the invention can be obtained, for example, from the following companies: Apparatebau Holzwarth GbR, Asperg, Wilhelm Fette GmbH, Schwarzenbek, Hofer GmbH, Weil, KILIAN, Cologne, KOMAGE, Kell am See, KORSCH Pressen GmbH, Berlin, Mapag Maschinenbau AG, Bern (Switzerland) and Courtoy N. V., Halle (BE/LU). One example of a particularly suitable tabletting machine is the model HPF 630 hydraulic double-pressure press manufactured by LAEIS, D.

The tablets can be made in certain shapes and certain sizes. Suitable shapes are virtually any easy-to-handle shapes, for example slabs, bars, cubes, squares and corresponding shapes with flat sides and, in particular, cylindrical forms of circular or oval cross-section. This last embodiment encompasses shapes from tablets to compact cylinders with a height-to-diameter ratio of more than 1.

The three-dimensional form of another embodiment of the tablets according to the invention is adapted in its dimensions to the dispensing compartment of commercially available domestic washing/dishwashing machines, so that the tablets can be introduced directly, i.e. without a dosing aid, into the dispensing compartment where they dissolve on contact with water or from which they are released during the dishwashing process. However, the cleaning tablets may of course also readily be used in conjunction with dosing aids.

A key feature of the process according to the invention is that the tablets produced in step a) have a cavity which is filled in step c) with the melt suspension or emulsion prepared in step b). This cavity may assume any of various geometric forms, the geometry of the cavity being independent of the geometry of the tablet. For example, round tablets may have round, elliptical, triangular, rectangular, pentagonal or polygonal cavities. The cavity shapes mentioned may also be present in rectangular or square tablets, in which the corners of the tablets may be rounded off.

The side walls of the cavity may also follow different paths, i.e. may assume any transitional forms from the vertical side wall to relatively flat straight lines or curved cavity walls. Particularly suitable cavity geometries are described in earlier German patent application 198 22 973.9 (Henkel). The geometric factors disclosed in that application also apply with advantage to the cavity tablets produced in step a) of the process according to the invention.

After tabletting, the cleaning tablets have high stability. The fracture resistance of cylindrical tablets can be determined via the diametral fracture stress. This in turn can be determined in accordance with the following $$\sigma = \frac{2P}{\pi D t}$$

where σ represents the diametral fracture stress (DFS) in Pa, P is the force in N which leads to the pressure applied to the tablet that results in fracture thereof, D is the diameter of the tablet in meters and t is its height.

Process Step b):

In process step b), a melt suspension or emulsion is prepared from a coating material which has a melting point above 30° C. and one or more active substance(s) dispersed or suspended therein. Suitable active substance(s) are in principle any of the ingredients typically used in detergents, more particularly the ingredients already mentioned and described in detail in the foregoing as optional ingredients of the premix to be tabletted. Particularly preferred active substances are separately described once again in the following.

Coating Materials:

The coating materials which form the "basis" of the melt suspension or emulsion prepared in step b) are expected to satisfy various requirements which relate on the one hand to the melting or solidification behavior and, on the other hand, to the material properties of the coating in the solidified state at ambient temperature. Since the coating is intended to permanently protect the active substances it surrounds against outside influences during transportation and storage, the coating material must show high stability to the impacts occurring, for example, during packaging or transportation. Accordingly, the coating should have either at least partly elastic or at least plastic properties in order to react to impact without breaking by elastic or plastic deformation. The coating material should have a melting range (solidification range) at temperatures at which the active substances to be coated are not exposed to significant thermal stressing. On the other hand, however, the melting range must be high enough to still afford the coated active substances effective protection at least slightly elevated temperatures. According to the invention, the coating materials have a melting point above 30° C.

It has been found to be of advantage if the coating material does not have a sharply defined melting point, as would normally be the case with pure crystalline substances, but rather a melting range possibly covering several degrees Celsius.

The coating material preferably has a melting range of about 45° C. to about 75° C. This means in the present case that the melting range lies within the temperature range mentioned and does not denote the width of the melting range. The width of the melting range is preferably at least 1° C. and more preferably about 2 to about 3° C.

The properties mentioned above are generally exhibited by so-called waxes. "Waxes" in the context of the present invention are understood to be any of a number of natural or synthetic substances which generally melt above 40° C. without decomposing and, even just above their melting point, are of relatively low viscosity and non-stringing. Their consistency and solubility are dependent to a large extent on temperature.

Waxes are divided into three groups according to their origin, namely: natural waxes, chemically modified waxes and synthetic waxes.

The natural waxes include, for example, vegetable waxes, such as candelilla wax, carnauba wax, Japan wax, esparto grass wax, cork wax, guaruma wax, rice oil wax, sugar cane wax, ouricury wax or montan wax, animal waxes, such as bees wax, shellac wax, spermaceti, lanolin (wool wax) or uropygial fat, mineral waxes, such as ceresine or ozocerite (earth wax), or petrochemical waxes, such as petrolatum, paraffin waxes or microwaxes.

The chemically modified waxes include, for example, hard waxes, such as montan ester waxes, sassol waxes or hydrogenated jojoba waxes.

Synthetic waxes are generally understood to be polyalkylene waxes or polyalkylene glycol waxes. Compounds from other classes which satisfy the above-mentioned softening point requirements may also be used as coating materials. For example, higher esters of phthalic acid, more particularly the dicyclohexyl phthalate commercially available under the name of Unimoll® 66 (Bayer AG), have proved to be suitable synthetic compounds. Synthetic waxes of lower carboxylic acids and fatty alcohols, for example the dimyristyl tartrate commercially available under the name of Cosmacol™ ETLP (Condea), are also suitable. Conversely, synthetic or partly synthetic esters of lower alcohols with fatty acids from native sources may also be used. This class of substances includes, for example, Tegin® 90 (Goldschmidt), a glycerol monostearate palmitate. Shellac, for example Schellack-KPS-Dreiring-SP (Kalkhoff GmbH), may also be used as a coating material in accordance with the invention.

In the context of the invention, the waxes also include, for example, the so-called wax alcohols. Wax alcohols are relatively high molecular weight water-insoluble fatty alcohols generally containing about 22 to 40 carbon atoms. The wax alcohols are used as a principal constituent of many natural waxes, for example in the form of wax esters of relatively high molecular weight fatty acids (wax acids). Examples of wax alcohols are lignoceryl alcohol (1-tetracosanol), cetyl alcohol, myristyl alcohol or melissyl alcohol. The coating of the solid particles coated in accordance with the invention may also contain wool wax alcohols which are understood to be triterpenoid and steroid alcohols, for example the lanolin obtainable, for example, under the name of Argowax® (Pamentier & Co.). According to the invention, fatty acid glycerol esters or fatty acid alkanolamides and also water-insoluble or substantially water-insoluble polyalkylene glycol compounds may also be used at least partly as a constituent of the coating.

In one preferred embodiment, the coating material used in step b) of the process according to the invention predominantly contains paraffin wax. In other words, at least 50% by weight of the total of coating materials present and preferably more consists of paraffin wax. Paraffin wax contents in the coating of about 60% by weight, about 70% by weight or about 80% by weight are particularly suitable, even higher contents of, for example, more than 90% by weight being particularly preferred. In one particular embodiment of the invention, the coating consists entirely of paraffin wax.

So far as the present invention is concerned, paraffin waxes have the advantage over the other natural waxes mentioned that the waxes do not undergo hydrolysis in an alkaline detergent environment (as might be expected, for example, in the case of the wax esters), because a paraffin wax does not contain any hydrolyzable groups.

Paraffin waxes consist principally of alkanes and small amounts of iso and cycloalkanes. The paraffin to be used in accordance with the invention preferably contains virtually no constituents with a melting point above 70° C. and, more preferably, above 60° C. If the temperature in the cleaning solution falls below this melting temperature, high-melting alkanes in the paraffin can leave unwanted wax residues behind on the surfaces to be cleaned or the ware to be cleaned. Wax residues such as these generally leave the cleaned surface with an unattractive appearance and should therefore be avoided.

The coating material used in step b) according to the invention preferably contains at least one paraffin wax with a melting range of 50° C. to about 55° C.

The paraffin wax used preferably has a high content of alkanes, isoalkanes and cycloalkanes solid at ambient temperature (generally about 10 to about 30° C.). The higher the percentage of solid wax constituents present in a wax at mom temperature, the more useful that wax is for the purposes of the present invention. The higher the percentage of solid wax constituents, the greater the resistance of the coating to impact or friction with other surfaces, which leads to longer lasting protection of the coated solid particles. Large percentages of oils or liquid wax constituents can weaken the particles so that pores are opened and the active substances are thus exposed to the outside influences mentioned.

Besides paraffin as principal constituent, the coating material may also contain one or more of the waxes or wax-like substances mentioned above. Basically, the composition of the mixture forming the coating material should be such that the coating is at least substantially insoluble in water. Their solubility in water should not exceed about 10 mg/l at a temperature of about 30° C. and should preferably be below 5 mg/l.

At all events, the coating should have very low solubility in water, even in water at elevated temperature, in order largely to avoid the coated active substances being released independently of temperature.

The principle described above facilitates the delayed release of ingredients (the active substances in the melt suspension or emulsion) at a certain time in the wash cycle and may be applied with particular advantage when the main wash cycle is carried out at a relatively low temperature (for example 55° C.), so that the active substance is only released from the melt coating in the final rinse cycle at relatively high temperatures (ca. 70° C.).

However, the principle mentioned may also be reversed so that the active substance(s) is/are released from the coating more quickly rather than with delay. In the process according to the invention, this may readily be achieved by using dissolution accelerators rather than dissolution retarders as coating materials, so that the melt suspension or emulsion solidified in the tablet dissolves more quickly than the tablet rather than more slowly. In contrast to the poorly water-soluble dissolution retarders described above, preferred dissolution accelerators are highly soluble in water. The solubility of the dissolution accelerators in water can be distinctly increased by certain additives, for example by incorporating readily soluble salts or effervescent systems. Quick-dissolving coating materials such as these (with or without additions of other solubility improvers) lead to rapid release of the coated active substances at the beginning of the wash cycle.

Particularly suitable dissolution accelerators, i.e. coating materials for the accelerated release of the active substances from the core cast into the tablet, are the above-mentioned synthetic waxes from the group of polyethylene glycols and polypropylene glycols.

Polyethylene glycols (PEGs) suitable for use in accordance with the invention are polymers of ethylene glycol which correspond to general formula III:

$$H—(O—CH_2—CH_2)_n—OH \quad \text{(III)}$$

in which n may assume a value of 1 (ethylene glycol) to more than 100,000. A critical factor in evaluating whether a polyethylene glycol is suitable for use in accordance with the invention is the aggregate state of the PEG, i.e. the melting point of the PEG must be above 30° C., so that the monomer (ethylene glycol) and the lower oligomers where n=2 to about 16 cannot be used because they have a melting point below 30° C. The polyethylene glycols with relatively high molecular weights are polymolecular, i.e. they consist of groups of macromolecules with different molecular weights. Various nomenclatures are used for polyethylene glycols which can lead to confusion. It is common practice to indicate the mean relative molecular weight after the initials "PEG", so that "PEG 200" characterizes a polyethylene glycol having a relative molecular weight of about 190 to about 210. Under this nomenclature, the standard polyethylene glycols PEG 1550, PEG 3000, PEG 4000 and PEG 6000 may advantageously be used for the purposes of the present invention.

Cosmetic ingredients are covered by another nomenclature in which the initials PEG are followed by a hyphen and the hyphen is in turn directly followed by a number which corresponds to the index n in general formula III above. Under this nomenclature (so-called INCI nomenclature, CTFA International Cosmetic Ingredient Dictionary and Handbook, 5th Edition, The Cosmetic, Toiletry and Fragrance Association, Washington, 1997), PEG-32, PEG-40, PEG-55, PEG-60, PEG-75, PEG-100, PEG-150 and PEG-180, for example, may advantageously be used in accordance with the present invention.

Polyethylene glycols are commercially obtainable, for example under the trade names of Carbowax® PEG 540 (Union Carbide), Emkapol® 6000 (ICI Americas), Lipoxol® 3000 MED (HÜLS America), Polyglycol® E-3350 (Dow Chemical), Lutrol® E4000 (BASF) and the corresponding trade names with higher numbers.

Polypropylene glycols (PPGs) suitable for use in accordance with the invention are polymers of propylene glycol which correspond to general formula IV:

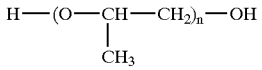

(IV)

where n may assume values of 1 (propylene glycol) to about 1000. As with the PEGs described above, a critical factor in evaluating whether a polypropylene glycol is suitable for use in accordance with the invention is the aggregate state of the PPG, i.e. the melting point of the PPG must be above 30° C., so that the monomer (propylene glycol) and the lower oligomers where n=2 to about 15 cannot be used because they have a melting point below 30° C.

Besides the PEGs and PPGs preferably used as adhesion promoters, other substances may of course also be used providing they have a sufficiently high solubility in water and a melting point above 30° C.

The melt suspension or emulsion prepared in process step b) may contain varying amounts of coating material, auxiliaries and active substance to be coated. In preferred processes, the coating material makes up 20 to 95% by weight, preferably 30 to 70% by weight and more preferably 40 to 50% by weight of the melt suspension or emulsion prepared in step b).

Active Substance(s)

The active substances to be incorporated in the melt suspension or emulsion may be present both in solid and in liquid form at the processing temperature (i.e. at the temperature at which the particles are produced) providing the melt suspension or emulsion is solid below its melting point or solidification range so that it permanently fills the cavity.

The active substances present In the melt suspension or emulsion perform certain functions in the cleaning tablet produced in accordance with the invention. Cleaning performance can be improved through the separation of certain substances or through the accelerated or delayed release of additional substances. Accordingly, active substances preferably incorporated in the melt suspension or emulsion are ingredients of detergents which are crucially involved in the washing or cleaning process.

Accordingly, in preferred processes, the active substance (s) in the melt suspension or emulsion prepared in step b) is/are selected from the group of enzymes, bleaching agents, bleach activators, surfactants, corrosion inhibitors, scale inhibitors, co-builders and/or perfumes.

By incorporating surfactants in molten coating material, it is possible to prepare a melt suspension or emulsion which provides additional detersive substance at a predetermined time in the final cleaning tablet according to the invention. For example, it is possible in this way to produce dishwasher tablets which only release the additional surfactant at temperatures which domestic dishwashers only reach in the final rinse cycle. In this way, additional detergent is available in the final rinse cycle to accelerate drainage of the water and thus effectively to prevent stains on the tableware. Thus, with a suitable quantity of solidified melt suspension or emulsion in the tablets produced by the process according to the invention, there is no longer any need to use the additional rinse aid typically encountered today. The separate addition and measuring of two products is thus replaced by the simple addition of a single tablet which saves time, effort and expense.

Accordingly, in preferred processes, the active substance (s) in the melt suspension or emulsion prepared in step b) is/are selected from the group of nonionic surfactants, more particularly alkoxylated alcohols. These substance have already been described in detail.

Another class of active substances which may be incorporated with particular advantage in the melt suspension or emulsion are bleaching agents. In their case, cleaning tablets can be produced which only release the bleaching agent on reaching certain temperatures, for example cleaning tablets which clean enzymatically in the prerinse cycle and only release the bleaching agent in the main wash cycle. Dishwasher detergents can also be produced in such a way that additional bleaching agents are released in the final rinse cycle so that difficult stains, for example tea stains, are more effectively removed.

Accordingly, in preferred processes, the active substance (s) in the melt suspension or emulsion prepared in step b) is/are selected from the group of oxygen or halogen bleaching agents, more particularly chlorine bleaching agents. These substances also have already been described in detail.

Another class of compounds which may be used with advantage as active substances in the melt suspension or emulsion are the bleach activators. Known bleach activators are compounds which contain one or more N- or O-acyl groups, such as substances from the class of anhydrides, esters, imides and acylated imidazoles or oximes. Examples are tetraacetyl ethylenediamine (TAED), tetraacetyl methylenediamine (TAMD) and tetraacetyl hexylenediamine (TAHD) and also pentaacetyl glucose (PAG), 1,5-diacetyl-2,2-dioxohexaydro-1,3,5-triazine (DADHT) and isatoic anhydride (ISA).

Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycourils, more particularly tetraacetyl glycoluril (TAGU), N-acylimides, more particularly N-nonanoyl succinimide (NOSI), acylated phenol sulfonates, more particularly n-nonanoyl- or isononanoyl-oxybenzenesulfonate (n- or iso- NOBS), carboxylic anhydrides, more particularly phthalic anhydride, acylated polyhydric alcohols, more particularly triacetin, ethylene glycol diacetate, 2,5-diacetoxy-2,5-dihydrofuran, n-methyl morpholinium acetonitrile methyl sulfate (MMA) and the enol esters known from German patent applications DE 196 16 693 and DE 196 16 767, acetylated sorbitol and mannitol and mixtures thereof (SORMAN), acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam. Substituted hydrophilic acyl acetals are also preferably used. Combinations of conventional bleach activators may also be used.

In addition to or instead of the conventional bleach activators mentioned above, so-called bleach catalysts may also be incorporated in the tablets. These substances are bleach-boosting transition metal salts or transition metal complexes such as, for example, manganese-, iron-, cobalt-, ruthenium or molybdenum-salen or -carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

Bleach activators from the group of polyacylated alkylenediamines, more particularly tetraacetyl ethylenediamine (TAED), N-acyl imides, more particularly N-nonanoyl succinimide (NOSI), acylated phenol sulfonates, more particularly n-nonanoyl- or isononanoyl-oxybenzenesulfonate (n- or iso-NOBS), n-methyl morpholinium acetonitrile methyl sulfate (MMA) are preferably used, preferably in quantities of up to 10% by weight, more preferably in quantities of 0.1% by weight to 8% by weight, most preferably in quantities of 2 to 8% by weight and, with particular advantage, in quantities of 2 to 6% by weight, based on the detergent as a whole.

Bleach-boosting transition metal complexes, more particularly containing the central atoms Mn, Fe, Co, Cu, Mo, V, Ti and/or Ru, preferably selected from the group of manganese and/or cobalt salts and/or complexes, more preferably the cobalt (ammine) complexes, cobalt (acetate) complexes, cobalt (carbonyl) complexes, chlorides of cobalt or manganese and manganese sulfate, are also present in typical quantities, preferably in a quantity of up to 5% by weight, more preferably in a quantity of 0.0025% by weight to 1% by weight and most preferably in a quantity of 0.01% by weight to 0.25% by weight, based on the detergent as a whole. In special cases, however, more bleach activator may even be used.

Perfumes may also be incorporated as active substances in the melt suspension or emulsion. All the perfumes described in detail in the foregoing may be used as active substance. Where perfumes are incorporated in the melt suspension or emulsion, detergents which release all or part of the perfume with delay are obtained. According to the invention, it is possible in this way for example to produce dishwasher tablets where the consumer experiences the perfume note even after the machine has been opened on completion of the program. In this way, the unwanted "alkali smell" characteristic of many dishwasher detergents can be eliminated.

Corrosion inhibitors may also be introduced as active substance into the particles, any of the corrosion inhibitors familiar to the expert being suitable. A combination of enzyme (for example lipase) and lime soap dispersant, for example, has been successfully used as a scale inhibitor.

Irrespective of the class of substances used as active substance, the active substance(s) normally make(s) up 5 to 50% by weight, preferably 10 to 45% by weight and more preferably 20 to 40% by weight of the melt suspension or emulsion prepared in step b).

Auxiliaries

At extremely low temperatures, for example at temperatures below 0° C., the coating can disintegrate under impact or friction. In order to improve stability at temperatures as low as these, additives may optionally be incorporated in the coating materials. Suitable additives must be completely miscible with the molten wax, should not significantly alter the melting range of the coating materials, should improve the elasticity of the coating at low temperatures, should generally not increase the permeability of the coating to water or moisture and should not increase the viscosity of the molten coating material to such an extent as to make processing difficult or even impossible. Suitable additives which reduce the brittleness of a coating consisting essentially of paraffin at low temperatures are, for example, EVA copolymers, hydrogenated resin acid methyl esters, polyethylene or copolymers of ethyl acrylate and 2-ethylhexyl acrylate.

Another useful additive where paraffin is used as the coating is a surfactant, for example a $C_{12-18}$ fatty alcohol sulfate, used in a small quantity. This additive improves the wetting of the material to be encapsulated by the coating. In one advantageous embodiment, it is added in a quantity of about <5% by weight and preferably <about 2% by weight based on the coating material. In many cases, the effect of adding an additive can be to promote the coating of even those active substances which, without the additive, would generally form a viscous plastic mass of paraffin and partly dissolved active substance after melting of the coating material.

It can also be of advantage in process step b) according to the invention to incorporate other additives in the coating material, for example to prevent premature sedimentation of the active substances to be coated during cooling. Suitable antisedimenting agents, which are also known as antisettling agents, are known from the prior art, for example from the production of paints and printing inks. Sedimentation phenomena and concentration gradients of the substances to be coated during the transition from the plastic solidification range to the solid can be counteracted, for example, by interfacially active substances, waxes dispersed in solvents, montmorillonites, organically modified bentonites, (hydrogenated) castor oil derivatives, soya lecithin, ethyl cellulose, low molecular weight polyamides, metal stearates, calcium soaps or hydrophobicized silicas. Other substances which have the effects mentioned belong inter alia to the groups of antifloating agents and thixotropicizing agents and, chemically, may be classed as silicone oils (dimethyl polysiloxanes, methylphenyl polysiloxanes, polyether-modified methylalkyl polysiloxanes), oligomeric titanates and silanes, polyamines, salts of long-chain polyamines and polycarboxylic acids, amine/amide-functional polyesters and amine/amide-functional polyacrylates.

Additives from the classes mentioned above are commercially available in large numbers. Commercial products which may advantageously be used as additives in the process according to the invention are, for example, Aerosil® 200 (pyrogenic silica, Degussa), Bentone® SD-1, SD-2, 34, 52 and 57 (bentonite, Rheox), Bentone® SD-3, 27 and 38 (hectorite, Rheox), Tixogel® EZ 100 or VP-A (organically modified smectite, Südchemie), Tixogel® VG, VP and VZ (QUAT-charged montmorillonite, Südchemie), Disperbyk® 161 (block copolymer, Byk-Chemie), Borchigen® ND (sulfo-group-free ion exchanger, Borchers), Ser- Ad® FA 601 (Servo), Solsperse® (aromatic ethoxylate, ICI), Surfynol® types (Air Products), Tamol® and Triton® types (Rohm & Haas), Texaphor® 963, 3241 and 3250 (polymers, Henkel), Rilanit® types (Henkel), Thixcin® E and R (castor oil derivatives, Rheox), Thixatrol® ST and GST (castor oil derivatives, Rheox), Thixatrol® SR, SR 100, TSR and TSR 100 (polyamide polymers, Rheox), Thixatrol® 289 (polyester polymer, Rheox) and the various M-P-A® types X, 60-X, 1078-X, 2000-X and 60-MS (organic compounds Rheox).

The additives mentioned may be used in varying quantities in the process according to the invention, depending on the coating material and the material to be coated. The antisettling agents, antifloating agents and thixotropicizing agents and dispersants mentioned above are typically used in concentrations of 0.5 to 8.0% by weight, preferably in concentrations of 1.0 to 5.0% by weight and more preferably in concentrations of 1.5 to 3.0% by weight, based on the melt suspension or emulsion.

According to the invention, therefore, preferred processes are characterized in that the melt suspension or emulsion prepared in step b) contains further auxiliaries from the group of antisedimenting agents, antisettling agents, antifloating agents, thixotropicizing agents and dispersion aids in quantities of 0.5 to 8.0% by weight, preferably in quantities of 1.0 to 5.0% by weight and more preferably in quantities of 1.5 to 3.0% by weight, based on the melt suspension or emulsion.

Particularly in the production of melt suspensions or emulsions containing additives which are liquid at the processing temperature, it is of advantage to use special emulsifiers. It has been found that, above all, emulsifiers from the group of fatty alcohols, fatty acids, polyglycerol esters and polyoxyalkylene siloxanes are particularly suitable.

In the context of the invention, fatty alcohols are understood to be the $C_{6-22}$ alcohols obtainable from native fats or oils via the corresponding fatty acids (see below). Depending on the origin of the fat or oil from which they are obtained, these alcohols may be substituted or locally unsaturated in the alkyl chain.

Accordingly, $C_{6-22}$ fatty alcohols, preferably $C_{8-22}$ fatty alcohols, more preferably $C_{12-18}$ fatty alcohols and most preferably $C_{16-18}$ fatty alcohols are used as emulsifiers in process step b) according to the invention.

Other suitable emulsifiers are any fatty acids obtained from vegetable or animal oils and fats. Irrespective of their aggregate state, the fatty acids may be saturated or mono- to polyunsaturated. With the unsaturated fatty acids also, the species solid at room temperature are preferred to the liquid or paste-form species. It is of course possible to use not only "pure" fatty acids, but also the technical fatty acid mixtures obtained in the hydrolysis of fats and oils, these mixtures being distinctly preferred from the economic point of view.

For example, individual species or mixtures of the following acids may be used as emulsifiers in accordance with the present invention: caprylic acid, pelargonic acid, capric acid, lauric acid, myristic acid, palmitic acid, stearic acid, octadecan-12-oleic acid, arachic add, behenic acid, lignoceric acid, cerotic acid, melissic acid, 10-undecenoic acid, petroselic acid, petroselaidic acid, oleic acid, elaidic acid, ricinoleic acid, linolaidic acid, α- and β-elaeostearic acid, gadoleic add, erucic acid, brassidic acid. It is of course also possible to use the fatty acids with an odd number of carbon atoms, for example undecanoic acid, tridecanoic acid, pentadecanoic acid, heptadecanoic acid, nonadecanoic acid, heneicosanoic acid, tricosanoic acid, pentacosanoic acid, heptacosanoic acid.

$C_{6-22}$ fatty acids, preferably $C_{8-22}$ fatty acids, more preferably $C_{12-18}$ fatty acids and most preferably $C_{16-18}$ fatty acids are used as emulsifier(s) in preferred process steps b).

According to the invention, particularly preferred emulsifiers are polyglycerol esters, more particularly esters of fatty acids with polyglycerols. These preferred polyglycerol esters may be represented by general formula V:

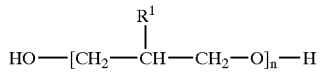

(V)

in which the substituents $R^1$ in each glycerol unit independently of one another represent hydrogen or a fatty acyl group containing 8 to 22 and preferably 12 to 18 carbon atoms and n is a number of 2 to 15 and preferably 3 to 10.

These polyglycerol esters are known and commercially available, more especially with degrees of polymerization n of 2, 3, 4, 6 and 10. Since substances of the type mentioned are also widely used in cosmetic formulations, some of them are also classified in the INCI nomenclature (CTFA International Cosmetic Ingredient Dictionary and Handbook, 5th Edition, The Cosmetic, Toiletry and Fragrance Association, Washington, 1997). For example, this cosmetic dictionary/handbook contains information on the keywords POLYGLYCERYL-3-BEESWAX, POLYGLYCERYL-3-CETYL ETHER, POLYGLYCERYL-4-COCOATE, POLYGLYCERYL-10-DECALINOLEATE, POLYGLYCERYL-10-DECAOLEATE, POLYGLYCERYL-10-DECASTEARATE, POLYGLYCERYL-2-DIISOSTEARATE, POLYGLYCERYL-3-DIISOSTEARATE, POLYGLYCERYL-10-DISOSTEARATE, POLYGLYCERYL-2-DIOLEATE, POLYGLYCERYL-3-DIOLEATE, POLYGLYCERYL-6-DIOLEATE, POLYGLYCERYL-10-DIOLEATE, POLYGLYCERYL-3-DISTEARATE, POLYGLYCERYL-6-DISTEARATE, POLYGLYCERYL-10-DISTEARATE, POLYGLYCERYL-10-HEPTAOLEATE, POLYGLYCERYL-12-HYDROXYSTEARATE, POLYGLYCERYL-10-HEPTASTEARATE, POLYGLYCERYL-6-HEXAOLEATE, POLYGLYCERYL-2-ISOSTEARATE, POLYGLYCERYL-4-ISOSTEARATE, POLYGLYCERYL-6-ISOSTEARATE, POLYGLYCERYL-10-LAURATE, POLYGLYCERYLMETHACRYLATE, POLYGLYCERYL-10-MYRISTATE, POLYGLYCERYL-2-OLEATE, POLYGLYCERYL-6-OLEATE, POLYGLYCERYL-4-OLEATE, POLYGLYCERYL-6-OLEATE, POLYGLYCERYL-8-OLEATE, POLYGLYCERYL-10-OLEATE, POLYGLYCERYL-6-PENTAOLEATE, POLYGLYCERYL-10-PENTAOLEATE, POLYGLYCERYL-6-PENTASTEARATE, POLYGLYCERYL-10-PENTASTEARATE, POLYGLYCERYL-2-SESQUIISOSTEARATE, POLYGLYCERYL-2-SESQUIOLEATE, POLYGLYCERYL-2-STEARATE, POLYGLYCERYL-3-STEARATE, POLYGLYCERYL-4-STEARATE, POLYGLYCERYL-8-STEARATE, POLYGLYCERYL-10-STEARATE, POLYGLYCERYL-2-TETRAISOSTEARATE, POLYGLYCERYL-10-TETRAOLEATE, POLYGLYCERYL-2-TETRASTEARATE, POLYGLYCERYL-2-TRIISOSTEARATE, POLYGLYCERYL-10-TRIOLEATE, POLYGLYCERYL-6-TRISTEARATE. The commercially obtainable products of various manufacturers which are classified under the above-mentioned keywords in the dictionary/handbook mentioned above may advantageously be used as emulsifiers in process step b) according to the invention.

Another group of emulsifiers which may be used in process step b) according to the invention are substituted silicones which carry side chains reacted with ethylene or propylene oxide. These polyalkylene siloxanes may be represented by general formula VI:

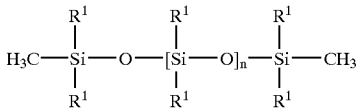

(VI)

in which the substituents $R^1$ independently of one another represent —$CH_3$ or a polyoxyethylene or polyoxypropylene group —[CH($R^2$)—$CH_2$—O]$_x$H group, $R^2$ represents —H or —$CH_3$, x is a number of 1 to 100, preferably 2 to 20 and more particularly below 10 and n is the degree of polymerization of the silicone.

The polyoxyalkylene siloxanes mentioned may also be etherified or esterified at the free OH groups of the polyoxyethylene or polyoxypropylene side chains. The unetherified and unesterified polymer of dimethyl siloxane with polyoxyethylene and/or polyoxypropylene is known under the INCI nomenclature as DIMETHICONE COPOLYOL and is commercially available under the names of Abil® B (Goldschmidt), Alkasil® (Rhône-Poulenc), Silwet® (Union Carbide) or Belsil® DMC 6031.

The DIMETHICONE COPOLYOL ACETATE esterified with acetic acid (for example Belsil® DMC 6032, 6033 and 6035, Wacker) and the DIMETHICONE COPOLYOL BUTYL ETHER (for example KF352A, Sin Etsu) may also be used as emulsifiers in process step b) according to the invention.

In the same way as the coating materials and the substances to be coated, the emulsifiers may be used over a widely varying range. Emulsifiers of the type mentioned normally make up 1 to 25% by weight, preferably 2 to 20% by weight and more preferably 5 to 10% of the weight of the melt suspension or emulsion.

In preferred processes, the melt suspension or emulsion prepared in step b) additionally contain emulsifiers from the group of fatty alcohols, fatty acids, polyglycerol esters and/or polyoxyalkylene siloxanes in quantities of 1 to 20% by weight, preferably in quantities of 2 to 15% by weight and, in a particularly preferred embodiment, in quantities of 2.5 to 10% by weight, based on the melt suspension or emulsion.

Process Step c)

In process step c), the separately produced cavity tablets are filled with the separately produced melt suspension or emulsion at temperatures above the melting temperature of the coating material. The temperature of the melt to be introduced may be selected as high as required although it is preferred with temperature-sensitive ingredients in mind to carry out process step c) at temperatures at most 10° C., preferably at most 5° C. and more preferably at most 2° C. above the solidification temperature of the melt suspension or emulsion.

The melt suspension or emulsion is preferably introduced into the cavity of the preformed tablet by a piston metering pump, a pneumatic pump, a flow inducer or a gear pump.

These pumps are familiar to the expert for various fields of application so that he will have no difficulty in selecting the right pump in terms of size, material and mode of operation, depending on the composition of the melt suspension or emulsion. Piston metering pumps have proved to be particularly suitable for melt suspensions or emulsions containing surfactants, bleaching agents or perfumes.

The tablets may be pretreated before filling with the melt in order to improve the adhesion of the melt in the cavity. For example, a suitable adhesion promoter may be applied to the cavity surfaces to ensure adhesion of the melt to the tablet so that the solidified cavity filling is unable to separate from the tablet during transportation and handling of the tablets.

It is more elegant and simpler in terms of process technology to heat the cavity tablets before they are filled with the melt suspension or emulsion in order to improve the adhesion of the cooling melt. In this way, the cooling melt is able at least partly to penetrate into the margins of the cavity and thus to provide for a strong and durable bond on solidification.

EXAMPLES

Production of Dishwasher Tablets

Process Step a): Production of Cavity Tablets

Two-layer rectangular tablets with a cavity in the form of a semi ellipse were produced by tabletting two different premixes. 75% by weight of the tablets consisted of lower phase and 25% by weight of upper phase. The composition (in % by weight, based on the particular premix) of the two premixes and hence of the two different phases of the cavity tablets is shown in the following Table:

| | Premix 1 (lower phase) | Premix 2 (upper phase) |
|---|---|---|
| Sodium carbonate | 32.0 | — |
| Sodium tripolyphosphate | 52.0 | 91.4 |
| Sodium perborate | 10.0 | — |
| Tetraacetyl ethylenediamine | 2.5 | — |
| Benzotriazole | 1.0 | — |
| $C_{12}$ fatty alcohol + 3 EO | 2.5 | — |
| Dye | | 0.2 |
| Enzymes | | 6.0 |
| Perfume | | 0.4 |
| Silicone oil | | 2.0 |

Process Step b): Preparation of Melt Suspensions/Emulsions

Three melt dispersions/emulsions SDE 1 to 3 were prepared by heating the coating material and stirring in the active substances and optional auxiliaries. Their compositions (% by weight, based on the melt) are shown in the following Table:

| | SDE 1 (bleach core) | SDE 2 (surfactant core) | SDE 3 (perfume core) |
|---|---|---|---|
| Paraffin 57–60° C. | 50.0 | 60.0 | 95.0 |
| Dichloroisocyanuric acid | 35.0 | — | — |
| Poly Tergent SLF-18B-45* | — | 33.3 | — |
| Perfume | — | — | 5.0 |
| Tylose MH 50 | 15.0 | — | — |
| Polyglycerol-12-hydroxystearate | — | 6.7 | — |

*alcohol alkoxylate of Olin Chemicals, softening point 25–45° C.

Process Step c): Casting of the Melt Suspensions/Emulsions into the Tablets

The melt dispersions/emulsions prepared in step b) were cast into the cavity tablets produced in process step a) in the following ratios by weight (figures=% by weight, based on the filled tablet), the tablets having been heated to 40° C. before filling:

| | Cavity tablet with bleach core | Cavity tablet with surfactant core | Cavity tablet with perfume core |
|---|---|---|---|
| Cavity tablet | 96.0 | 96.0 | 96.0 |
| SDE 1 | 4.0 | — | — |
| SDE 2 | — | 4.0 | — |
| SDE 3 | — | — | 4.0 |

Process Step d): Cooling and Aftertreatment

The filled tablets were left to cool at room temperature and then individually wrapped.

The cavity tablets with a bleach core had a distinctly superior cleaning performance, particularly against tea stains, in relation to tablets of similar composition where the ingredients of the melt dispersion/emulsion were added to the premix individually and not in the form of a melt.

The cavity tablets with a surfactant core showed distinctly better clear-rinse performance—reflected in a considerably reduced bloom on glasses—compared with tablets of similar composition where the ingredients of the melt dispersion/emulsion were added to the premix individually and not in the form of a melt.

The cavity tablets with a perfume core had a distinctly better perfume note on opening of the machine compared with tablets of similar composition where the ingredients of the melt dispersion/emulsion were added to the premix individually and not in the form of a melt.

All the tests mentioned above were carried out by several examiners in several commercially available dishwashers, the tablets being placed in the dispensing compartment of the machine and a 55° C.-program being run with the machine fully loaded. In none of the tests were any additional detergents or rinse aids used.

The preceding Examples relate to tablets in which the cast-in core is released with delay. In further Examples, melt dispersions of n-methyl morpholinium acetonitrile methyl sulfate (MMA) in readily soluble coating materials were prepared to demonstrate the positive effects obtained even with accelerated release.

Cavity tablets were produced by process step a) as described above. Melt dispersions SDE 4 to SDE 8 were prepared by heating the particular coating material and stirring in the active substance (MMA), their compositions (% by weight, based on the melt) being shown in the following Table:

| | SDE 4 | SDE 5 | SDE 6 | SDE 7 | SDE 8 |
|---|---|---|---|---|---|
| Sokalan ® BM 1* | 44.0 | 50.0 | 60.0 | 60.0 | 60.0 |
| PEG 1550 (Mp. 45–50° C.) | 44.0 | 50.0 | 40.0 | — | — |
| PEG 3000 (Mp. 50–56° C.) | — | — | — | 40.0 | — |
| PEG 4000 | — | — | — | — | 40.0 |
| Citric acid | 4.8 | — | — | — | — |
| Sodium hydrogen carbonate | 7.2 | — | — | — | — |

*n-methyl morpholinium acetonitrile methyl sulfate (MMA), ca. 50% on a support (BASF)

The melt dispersions were cast into the tablets as described above and allowed to cool. The tablets had a weight before filling of 24 g and were each filled with 1.3 g of the melt dispersion. The cleaning performance of tablets E4 to E8 filled with melt dispersions SDE 4 to SDE 8 was tested against tea soils. To this end, a tea soil was prepared as described in (1) and the soiled cups were cleaned in a commercially available dishwasher.

(1) Preparation of the Tea Soil

16 Liters of cold mains water (16° dH) were heated briefly to boiling point in a water heater. With the lid on, 96 g of black tea in a nylon gauze were allowed to draw for 5 minutes, after which the tea was transferred to an immersion apparatus equipped with a heating system and stirrer.

60 Teacups were immersed 25 times for 1 minute in the prepared tea brew at 70° C. The cups were then removed and placed upside-down on a draining board to dry.

(2) Test Results

The cleaning performance of the tablets against the tea soil prepared as described in (1) was visually evaluated by experts on a scale of 0 to 10 where a score of "0" means no cleaning and a score of "10" means complete removal of the soils. The tea scores were measured both for washing conditions of 55° C./16° d water hardness in the main wash cycle (i.e. "hard conditions") and for 55° C./3° d water hardness. A Miele G 590 (universal program) was used as the dishwasher. The cleaning results obtained with tablets E4 to E8 by comparison with an unfilled tablet C are shown in the following Table:

| | C | E4 | E5 | E6 | E7 | E8 |
|---|---|---|---|---|---|---|
| Tea score 3° d | 7.0 | 10.0 | 9.5 | 9.7 | 9.0 | 8.0 |
| Tea score 16° d | 4.7 | 7.0 | 6.8 | 8.0 | 7.5 | 5.7 |

The results show that tablets E4 to E8 according to the invention are far superior to the comparison tablet C in the removal of tea stains.

What is claimed is:

1. A process for the production of multiphase cleaning tablets comprising the steps of;

a) tabletting a particulate premix to form tablets with a cavity;

b) preparing a melt suspension or emulsion from a coating material with a melting point above 30° C., the coating material comprising at least one natural or chemically modified wax, and one or more active substance(s) dispersed or suspended therein;

c) filling the cavity tablets with the melt suspension or emulsion at a temperature above the melting point of the coating material; and d) cooling and optionally aftertreating the filled cleaning tablets.

2. The process as claimed in claim 1, wherein the particulate premix tabletted in step a) contains builders in quantities of 20 to 80% by weight, based on the premix.

3. The process as claimed in claim 1, wherein the particulate premix tabletted in step a) contains surfactant(s) in quantities of 0.5 to 10% by weight based on the premix.

4. The process as claimed in claim 1, wherein the particulate premix tabletted in step a) has a bulk density above 600 g/l.

5. The process as claimed in claim 1, wherein the particulate premix tabletted in step a) has a particle size distribution where less than 10% by weight of the particles are larger than 1600 μm or smaller than 200 μm.

6. The process as claimed in claim 5, wherein the particulate premix tabletted in step a) has a particle size distribution where more than 30% by weight of the particles are between 600 and 1,000 μm in size.

7. The process as claimed in claim 1, wherein multilayer tablets comprising a cavity are tabletted in step a) by pressing several different particulate premixes onto one another.

8. The process as claimed in claim 7, wherein two-layer tablets comprising a cavity are tabletted in step a) by pressing onto one another a first particulate premix and a second particulate premix, wherein the first premix contains one or more bleaching agents and the second premix contains one or more enzymes.

9. The process as claimed in claim 7, wherein two-layer tablets comprising a cavity are tabletted in step a) by pressing onto one another a first particulate premix and a second particulate premix, wherein the first premix contains one or more bleaching agents and the second premix contains one or more bleach activators.

10. The process as claimed in claim 1, wherein the coating material in step b) has a melting range of 45° C. to 75° C.

11. The process as claimed in claim 1, wherein the coating material contains at least one paraffin wax with a melting range of 50° C. to 55° C.

12. The process as claimed in claim 1, wherein the coating material additionally contains at least one substance selected from the group consisting of polyethylene glycols (PEGs), polypropylene glycols (PPGs), and mixtures thereof.

13. The process as claimed in claim 1, wherein the coating material makes up 20 to 95% by weight of the melt suspension or emulsion prepared in step b).

14. The process as claimed in claim 1, wherein the active substance(s) in the melt suspension or emulsion prepared in step b) comprises a member selected from the group consisting of enzymes, bleaching agents, bleach activators, surfactants, corrosion inhibitors, scale inhibitors, cobuilders, perfumes, and mixtures thereof.

15. The process as claimed in claim 14, wherein the active substance(s) in the melt suspension or emulsion prepared in step b) comprises a member selected from the group consisting of nonionic surfactants.

16. The process as claimed in claim 14, wherein the active substance(s) in the melt suspension or emulsion prepared in step b) comprises a member selected from the group consisting of oxygen bleaching agents or halogen bleaching agents.

17. The process as claimed in claim 14, wherein the active substance(s) in the melt suspension or emulsion prepared in step b) comprises a bleach activator selected from the group consisting of polyacylated alkylenediamines, N-acylimides, acylated phenol sulfonates, n-methyl morpholinium acetonitrile methylsulfate (MMA), and mixtures thereof.

18. The process as claimed in claim 1, wherein the active substance(s) comprises 5 to 50% by weight of the melt suspension or emulsion prepared in step b).

19. The process as claimed in claim 1, wherein the melt suspension or emulsion prepared in step b) contains an auxiliary selected from the group consisting of antisedimenting agents, antisettling agents, antifloating agents, thixotropicizing agents, dispersion aids, and mixtures thereof in quantities of 0.5 to 8.0% by weight, based on the melt suspension or emulsion.

20. The process as claimed in claim 1, wherein the melt suspension or emulsion prepared in step b) additionally contains an emulsifier selected from the group consisting of fatty alcohols, fatty acids, polyglycerol esters, polyoxyalkylene siloxanes, and mixtures thereof in quantities of 1 to 20% by weight, based on the melt suspension or emulsion.

21. The process as claimed in claim 1, wherein step c) is carried out at temperatures at most 10° C., above the solidification temperature of the melt suspension or emulsion.

22. The process as claimed in claim 1, wherein, in step c), the melt suspension or emulsion is introduced into the cavity tablet by a means selected from the group consisting of a piston metering pump, a pneumatic pump, a flow inducer or a gear pump.

23. The process as claimed in claim 1, wherein, before filling with the melt suspension or emulsion, the cavity tablets are heated to improve the adhesion of the cooling melt to the tablet.

24. A process for the production of multiphase cleaning tablets comprising the steps of;

a) tabletting a particulate premix to form tablets with a cavity;

b) preparing a melt suspension or emulsion from a coating material with a melting point above 30° C., the coating material comprising at least 50% by weight of one or more paraffin waxes, and one or more active substance (s) dispersed or suspended therein;

c) filling the cavity tablets with the melt suspension or emulsion at a temperature above the melting point of the coating material; and d) cooling and optionally aftertreating the filled cleaning tablets.

25. The process of claim 24, wherein the coating material comprises at least 60% by weight of one or more paraffin waxes.

26. The process of claim 25, wherein the coating material comprises at least 70% by weight of one or more paraffin waxes.

27. The process of claim 26, wherein the coating material comprises at least 80% by weight of one or more paraffin waxes.

28. The process of claim 27, wherein the coating material comprises more than 90% by weight of one or more paraffin waxes.

29. The process of claim 28, wherein the coating material comprises 100% by weight of one or more paraffin waxes.

30. The process of claim 24, wherein the one or more paraffin waxes comprise no constituents having a melting point above 70° C.

31. The process of claim 30, wherein the one or more paraffin waxes comprise no constituents having a melting point above 60° C.

32. The process of claim 24, wherein the one or more paraffin waxes comprise at least one paraffin wax having a melting range of 50° C. to 55° C.

* * * * *